US005500987A

United States Patent [19]

Rosen

[11] Patent Number: 5,500,987

[45] Date of Patent: Mar. 26, 1996

[54] PIN CLIP

[75] Inventor: Howard J. Rosen, Huntington Beach, Calif.

[73] Assignee: FloTool International, Inc., Tustin, Calif.

[21] Appl. No.: 246,514

[22] Filed: May 20, 1994

[51] Int. Cl.[6] ..... A44B 21/00; A45F 5/00

[52] U.S. Cl. ..... 24/351; 24/3.11; 24/353; 411/485; 248/316.7

[58] Field of Search ..... 24/351, 353, 354, 24/355, 67.9, 511, 461, 3 J, 3 L, 363, 362; 248/316.7; 211/89; 411/923, 485

[56] References Cited

U.S. PATENT DOCUMENTS

| | | | |
|---|---|---|---|
| 340,831 | 4/1886 | Shelby . | |
| 631,754 | 8/1899 | Sanders . | |
| 780,962 | 1/1905 | Perry | 24/3 J |
| 850,261 | 4/1907 | Smith | 24/3 J |
| 948,917 | 2/1910 | Boyland . | |
| 1,070,403 | 8/1913 | Bryant . | |
| 1,072,903 | 9/1913 | Bippart | 24/353 |
| 1,257,406 | 2/1918 | Sauerman . | |
| 1,314,548 | 9/1919 | Taylor . | |
| 1,439,138 | 12/1922 | White . | |
| 1,502,512 | 7/1924 | Mezei | 24/3 J |
| 1,594,051 | 7/1926 | DeMos | 24/353 |
| 1,997,425 | 4/1935 | Melder et al. . | |
| 3,379,237 | 4/1968 | Worthington . | |
| 3,911,516 | 10/1975 | Einhorn | 411/923 |
| 3,950,829 | 4/1976 | Cohen . | |
| 3,965,546 | 6/1976 | Hickle | 24/461 |
| 4,132,381 | 1/1979 | McClellan | 211/89 |
| 4,506,416 | 3/1985 | Ohminato et al. . | |
| 4,536,924 | 8/1985 | Willoughby . | |
| 4,581,481 | 4/1986 | Moretti . | |
| 4,839,947 | 6/1989 | Cohen et al. . | |
| 4,887,324 | 12/1989 | Cairns . | |
| 5,027,480 | 7/1991 | Hogarth . | |
| 5,123,146 | 6/1992 | Olson . | |
| 5,152,034 | 10/1992 | Konings et al. . | |
| 5,236,760 | 8/1993 | Jinn . | |
| 5,337,987 | 8/1994 | Sawatsky | 248/316.7 |

FOREIGN PATENT DOCUMENTS

| | | | |
|---|---|---|---|
| 1134194 | 4/1957 | France . | |
| 0061908 | 7/1907 | United Kingdom | 24/354 |
| 0363917 | 12/1931 | United Kingdom | 24/354 |
| 2066890 | 7/1981 | United Kingdom . | |

*Primary Examiner*—Victor N. Sakran
*Attorney, Agent, or Firm*—Harold L. Jackson

[57] ABSTRACT

A pin clip for holding paper items and the like has a back member and a tongue which resiliently engages the back member. The back member typically has an outwardly extending finger. The Tongue is coupled to the back member by a spring means. A pin extends out of the back member for attaching the pin clip to bulletin boards or the like.

19 Claims, 3 Drawing Sheets

PIN CLIP

BACKGROUND OF THE INVENTION

1. Field of the Invention

The invention relates generally to clips and more particularly to pin clips affixed to vertically disposed surfaces, such as bulletin, boards for providing a clamping function.

2. Description of Related Art

Historically, many fastening arrangements have been developed during the last century to provide hooking, clipping, or clamping functions which have been used to hang, hold, or close a variety of desired items. For example, clasps are illustrated in U.S. Pat. No. 340,831 (1886), U.S. Pat. No. 631,754 (1899) and U.S. Pat. No. 948,917 (1910); hangers in U.S. Pat. No. 1,257,406 (1918) and U.S. Pat. No. 4,839,947 (1989); holders in U.S. Pat. No. 1,439,138 (1922); clamps in U.S. Pat. No. 1,997,425 (1935) and U.S. Pat. No. 4,536,924 (1985); fasteners in U.S. Pat. No. 1,070,403 (1913) and U.S. Pat. No. 1,314,548 (1919); bag closures in U.S. Pat. No. 5,123,146 (1992); clips in U.S. Pat. No. 5,027,480 (1991) and U.S. Pat. No. 3,950,829 (1976), and retainers in U.S. Pat. No. 4,887,324 (1989). The devices disclosed in the aforementioned patents typically were designed to perform specific tasks such as to hold items from paper products to articles of clothing, from bags to cables, and from curtains to pictures, for example.

Other simple clip arrangements are illustrated more closely in the following patents. To hold paper items and the like, alternatives to the traditional paper clip have evolved, such as illustrated in U.S. Pat. No. 4,506,416 issued to Ohminato et al. which discloses a paper clip having an arched moveable member, a bottom plate and a connector plate therebetween all formed as one piece. Another clip device is disclosed in U.S. Pat. No 5,152,034 entitled Click-clip which clip is extruded of synthetic resin material comprising relatively stiff wing portions connected by a living hinge wherein each wing portion has a foot portion with a hook portion at the end thereof for mutual interlocking. This clip is adapted for closing, reopening and reclosing respectively the edges of a bag, which bag is made from plastic film or similar material having a single thickness varying between about 0.01 and 1 mm. A guard ring clip disclosed in a patent issued to Moretti namely, U.S. Pat. No. 4,581,481 consists of two half collars of a hard elastic plastic material integrally joined by a hinge strap at one end and having interlocking hooks at their free ends to form a closed ring that tightly encloses a cable. A clip disclosed in U.K. Patent Application GB 2,066,890 which provides a spring clip for attachment to a jacket to hold an identification tag or card. This clip has two parts a base or housing 11 with a stud for attachment to a supporting surface such as a plastic badge and a trigger part 20 secured in the housing and biased against a curved jaw portion of the housing by spring arm 16 also formed integrally with the housing.

With all these fastening arrangements, there has yet to be a simple alternative to traditional thumb tack for securing items to a bulletin board or the like. Thumb tacks undersireably poke holes in the item to be "pegged up" and often result in tearing of the item which is typically a piece paper or the like. Thumb tacks are also easily dislodged from a bulletin board resulting in the paper item falling to the ground and the thumb tack ending up in a location where it could possibly cause injury to an unsuspecting passerby. It would be an advancement to the art to have a pin clip arrangement for securely suspending paper items and the like, in a more reliable manner.

SUMMARY OF THE INVENTION

It is therefore an object of the invention to provide a pin clip of simple structure which is relatively easy to manufacture.

It is another object of the invention to provide a pin clip that is primarily made of synthetic plastic which has good grip strength.

It is still a further object of the invention to provide a pin clip which can readily be affixed to a bulletin board and the like for holding paper products or other items.

A pin clip according to the present invention comprises a back member having an overhanging finger and a tongue, which tongue cooperatively engages the overhanging finger to hold an item such as paper products therebetween. A pin protrudes outwardly from the back surface of the back member for tacking the pin clip to an upright surface. The pin may be integrally formed as part of the back member in a molding process or added to the back member before use of the clip by means of a receiving countersunk hole through the back member.

DESCRIPTION OF PREFERRED EMBODIMENTS

Figure 1:
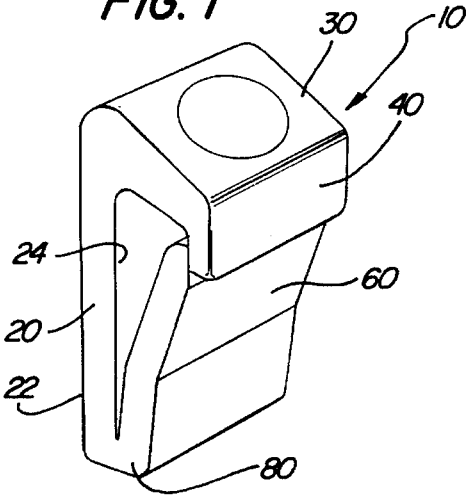
FIG. 1 is a perspective view of a preferred pin clip arrangement.
Figure 2:
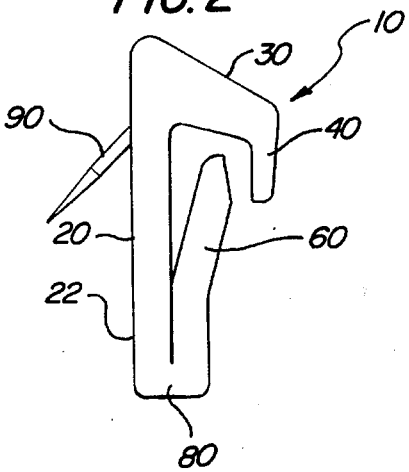
FIG. 2 is a side elevational view of the pin clip of FIG. 1 with its tongue depressed.
Figure 3:
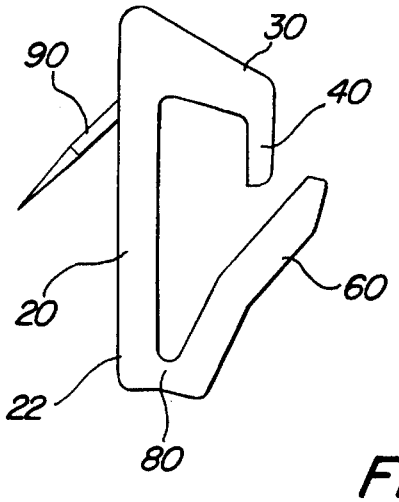
FIG. 3 is a side elevational view of the pin clip of FIG. 1.

Referring now with more particularity to the drawings, FIGS. 1–3 illustrate a preferred embodiment of a pin clip 10 according to the principles of the invention which includes back member 20 having a flat back major surface 22 which provides a mounting surface for a vertically disposed structure. At one end of the back member 30, finger 30 extends forwardly from the back member 20 and has a downwardly bent finger digit 40 which extends a short distance over the back member 20 and its front major surface 24. Tongue 60 extends from the other end of the back member 20 in an upwardly and outwardly direction. FIG. 3 shows a side elevational view of clip 10 as it would appear after forming the clip 10 such as by conventional molding techniques. More specifically, pin clip 10 is formed in a configuration such that the tongue 60 extends outside finger digit 40 by spring means 80 in its normal unbiased condition. The tongue 60 is bent under the finger digit 40 and due to the spring means 80, which directs tongue 60 outwardly, seats the tongue 60 against the finger digit 40 in resilient engagement together. As shown in FIG. 2, the tongue 60 may be depressed toward the back member 20 by finger pressure to overcome the bias action of the spring means 80, to thereby open a space between tongue 60 and finger digit 40 for insertion or removal of an item therebetween. The clip may be readily made using well known molding fabrication techniques from synthetic plastic material having resilient properties to form a unitary plastic structure. While other techniques may be used to fabricate the clip, molding provides a simple technique to reliably manufacture large numbers of clips.

The pin clip may be affixed to a surface by a variety of wall fastening means; however, in this example a pin 90 is illustrated in a preferred arrangement. The head portion of the pin 90 may be embedded into the upper portion of back member 20 during the molding fabrication process. Pin 90 extends from the back member 20 protruding outwardly at some predetermined angle with respect to its back major surface 22. In this example, the pin may be disposed at an angle between about 45 to 75 degrees with respect to the back major surface 22. The pin 90 is useful for affixing the clip to conventional bulletin boards and the like (not shown), which typically have a cork-like surface.

Figure 4:
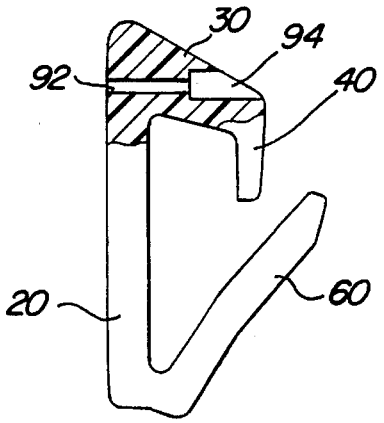
FIG. 4 is a partially broken away side view illustrating another example of mounting a pin in a pin clip of the present invention.
Figure 5:
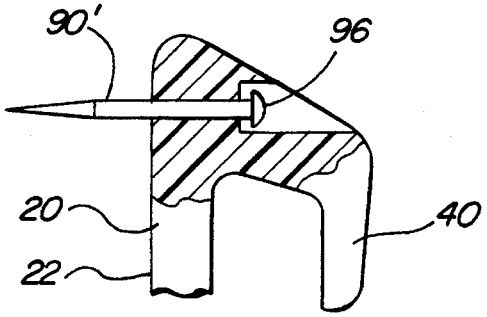
FIG. 5 is a partially broken away enlarged side elevational view illustrating the pin clip of FIG. 4 with a pin installed.

An alternative method for providing the pin clip with a pin is illustrated in FIGS. 4 and 5. During the molding process (or at some time thereafter using conventional drilling techniques) a hole 92 with a countersunk portion 94 is formed traversly through the upper portion of clip 10. A pin 90' is pushed into the hole and the head 96 of pin 90' seats in the countersunk portion 94. The diameter of countersunk hole portion 94 is selected such that it is slightly smaller than the diameter of the pin head 96. The pin head 96 will therefore be held snugly within the countersunk hole portion 94 preventing the pin 90' from backing out of hole 92. While pin fastening arrangements have been illustrated, many other fastening means are possible to affix the plastic clip to a surface such as, Velcro (TM), hooks, magnets or suction cups. The fastening arrangement used of course will depend on the ultimate intended receiving surface. For example, suction cups may be desirable for a smooth hard surface such as a ceramic tile, while magnets may work well with a metal surface such as that of a refrigerated door.

Figure 6:
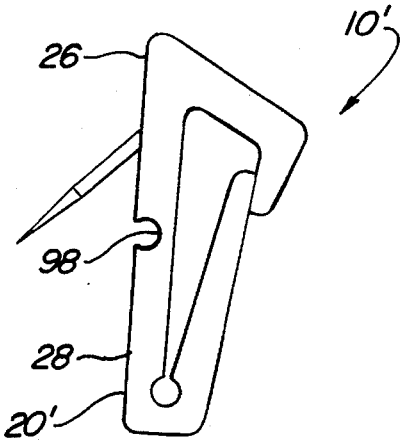
FIG. 6 is a side elevational view of a modified pin clip of FIG. 1.
Figure 7:
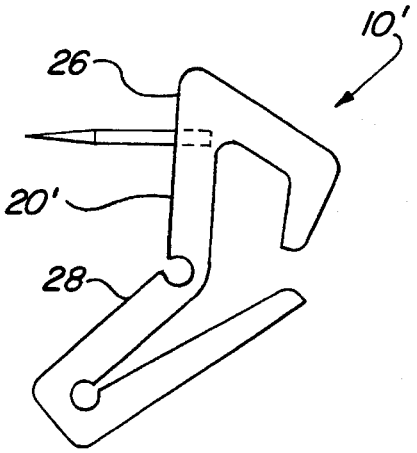
FIG. 7 is a side view of the pin clip of FIG. 6 in its unbiased condition.
Figure 8:
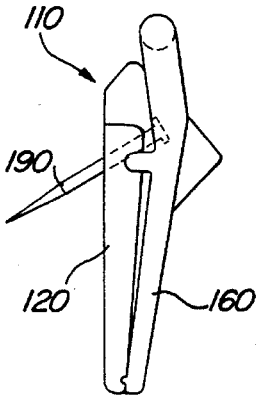
FIG. 8 is a side elevational view of another pin clip arrangement.
Figure 9:
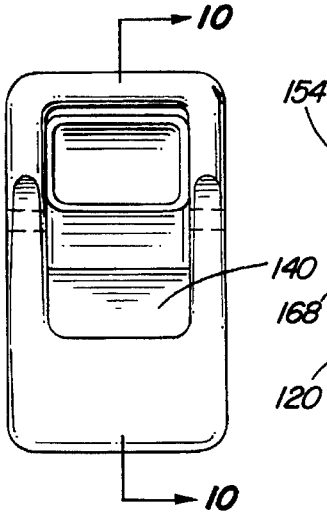
FIG. 9 is a front view of the pin clip of FIG. 8.

FIG. 6 and 7 show a modification to the aforedescribed pin clip 10, namely pin clip 10'. For pin clip 10', the back member 20' consists of the two halves, upper and lower back member halves 26 and 28 which are integrally joined by hinge spring means 98. FIG. 7 shows a cross-sectional elevational view of pin 10' as it would appear after it was formed such as by molding. As illustrated in FIG. 7, pin clip 10' and spring hinge means 98 have an unbiased condition wherein the upper and lower back member halves 26 and 28 are slightly backwardly bent with respect to each other, forming an obtuse angle therebetween. Pin 90 may be formed integrally as part of this clip while other fastening arrangements are possible as discussed above in relation to pin clip 10. When the pin clip 10' is affixed to a surface, such as a conventional bulletin board, the lower back member half 28 is bent such that the two back member halves are coplanarly aligned. The bias action of the hinge spring means on the lower back member half 28 assists in the retention of clip 10' in a receiving surface.

An alternative embodiment pin clip 110 is illustrated on FIGS. 8–11 which also includes a back member 120 having an overhanging finger 130 with a downwardly bent finger digit 140. A tongue member 160 has a hole 162 therethrough such that the finger digit 140 can be inserted through the hole 162 and the tongue 160 located adjacent to the back member front major surface 124. The back member 120 and tongue 160 have cooperative locking means 150 to hold the tongue and back member in relative position and resiliently bias these two members together. Tongue member 160 has a recessed area 164 which is sized and shaped similarly to the extent of the finger digit 140 which is plate-like in shape. When mated the finger digit slides into the recessed area 164 of the tongue 160, the finger digit 140 applying resilient pressure on the tongue 160. The cooperative locking means further comprises short male ridges 166 and 168 and female receiving channels or grooves 152 and 154 which are arranged on the tongue and back member 120 in this particular embodiment in parallel but spaced relationship outside the lateral extent of the finger 130. Upon assembly of the tongue 160 and back member 120, the ridges 166 and 168 slide over the front major surface 124 of back member 120 and are pushed by the pressure of the finger digit 140 on the tongue into their respective mating female receiving channels 152 and 154. While a pair of male ridges and female channels have been illustrated many other such arrangements are possible which hold or lock the tongue and back member in relative position together while allowing the finger digit to resiliently hold the tongue against the back member.

Figure 10:
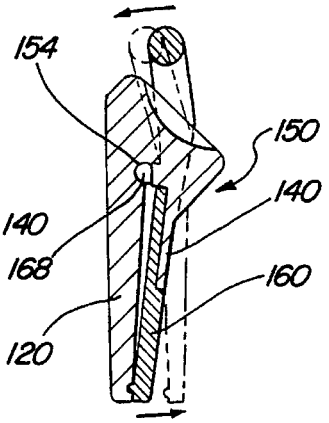
FIG. 10 is a side cross-sectional elevational view of the pin clip arrangement taken at the line 10—10 of FIG. 9.
Figure 11:
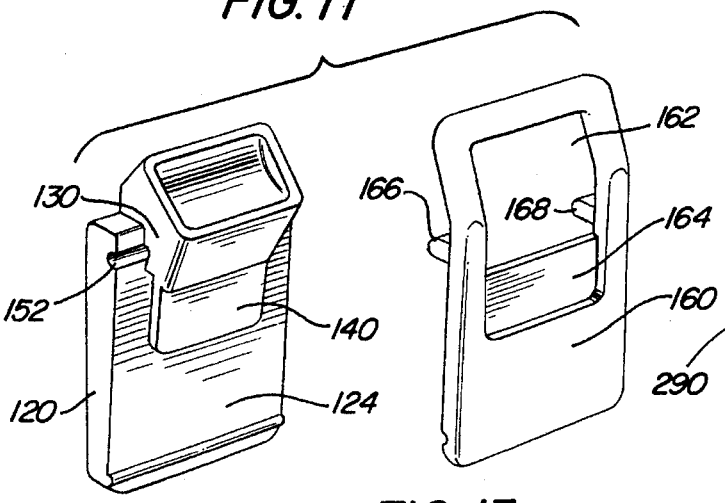
FIG. 11 illustrates perspective views of the two member of the pin clip of FIG. 8 prior to assembly.

When the tongue 160 and back member 120 are assembled, to replace or remove paper or other objects therebetween, one pivots by finger pressure at the top portion of the tongue, the tongue away from the back member opening up a space therebetween, as shown in FIG. 10. Ridges 166 and 168 serve as pivot points in their respective female channels 152 and 154. The tongue remains under the finger by the locking means but is resiliently biased by the finger and finger digit. Accordingly, the back member, and tongue too, are preferably fabricated out of plastic material having resilient properties. As above, molding the clip provides a preferred fabrication technique.

A pin 90 may be integrally formed as part of the clip during the molding process. The pin is preferably located in the upper portion of the back member and directed out the back major surface. While a pin is preferred as a fastening arrangement to a desired surface, other fastening means, as illustrated above are possible and lie within the scope of this invention.

Figure 12:
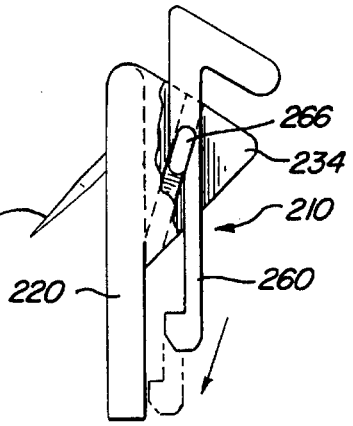
FIG. 12 is a partially broken away side view of another pin clip arrangement.
Figure 13:
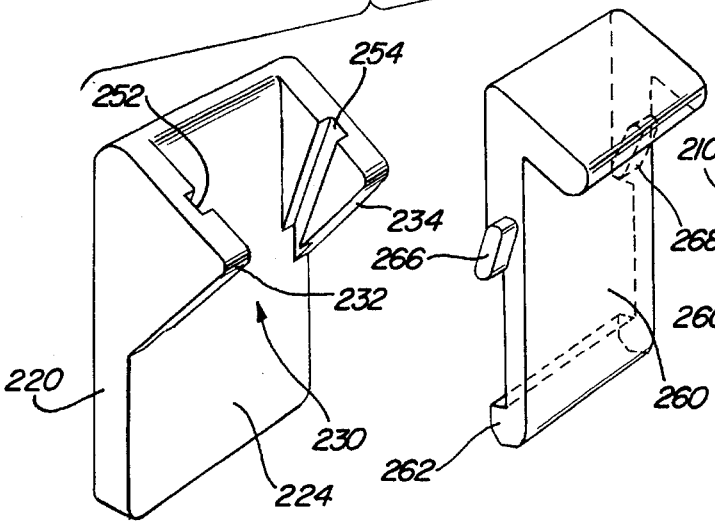
FIG. 13 illustrates perspective views of the two members of the pin clip of FIG. 12 prior to assembly.
Figure 14:
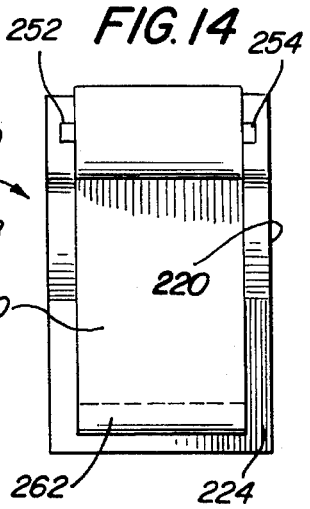
FIG. 14 is a front view of the pin clip of FIG. 12 in its closed position.

FIGS. 12–14 illustrate another pin clip embodiment 210 which includes back member 220 and tongue 260. Back member 220 has a finger means 230 with two forwardly projecting fingers 232 and 234. Elongated channels 252 and 254 traverse the inside of the fingers in a downwardly and backwardly direction. Tongue 260 has two sliding tabs 266 and 268 disposed on opposite side edges of the tongue which sliding tabs are sized to be received by respective elongated channels 252 and 254. In assembly, tongue 260 is placed between fingers 232 and 234 with tabs 266 and 268 in sliding engagement within channels 252 and 254. Tongue 260 may be pushed downwardly such that tip 262 resiliently engages back member 220 front major surface 224. Pin 290 protrudes outwardly from the back member to affix pin clip 210 to a desired surface.

Figure 15:
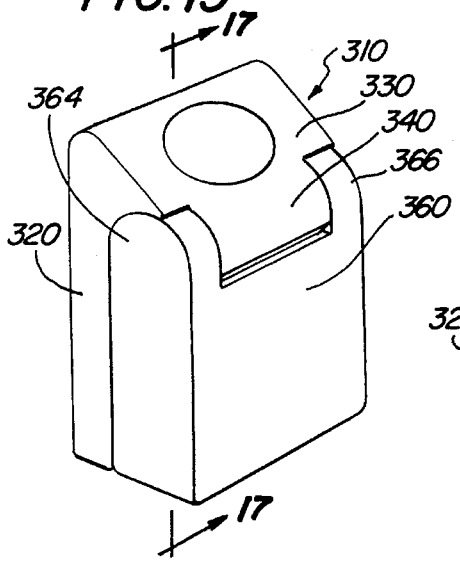
FIG. 15 is a perspective view of another pin clip arrangement.
Figure 16:
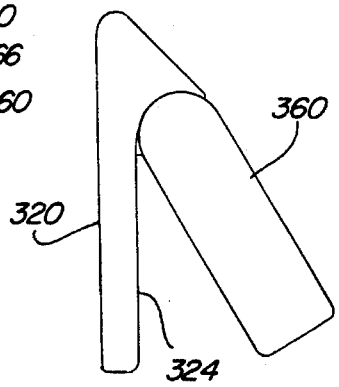
FIG. 16 is a side elevational view of the pin clip arrangement of FIG. 15 in its open position.
Figure 17:
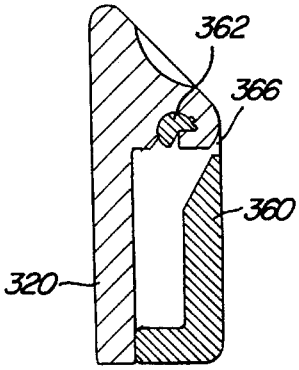
FIG. 17 is a side cross-sectional elevational view of the pin clip of FIG. 15 in its closed position taken at the line 17—17 of FIG. 15.
Figure 18:
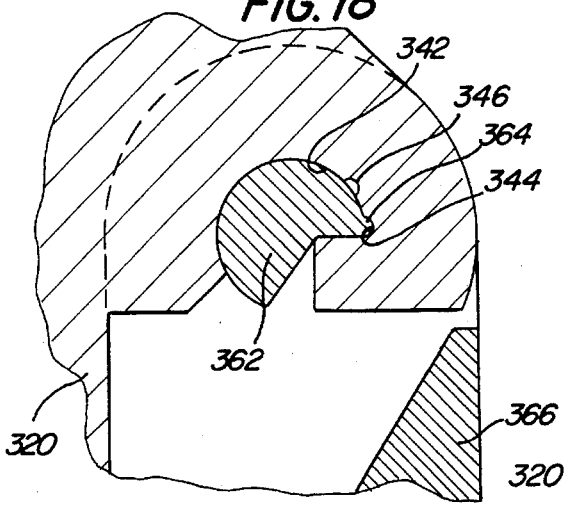
FIG. 18 is an enlarged broken away partial side view showing the pin clip of FIG. 15 in its closed position.
Figure 19:
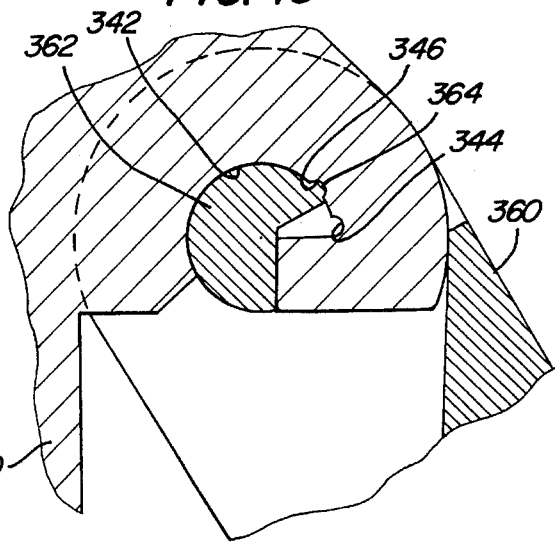
FIG. 19 is an enlarged broken away partial side view showing the pin clip of FIG. 15 in its open position.

Yet another pin clip embodiment 310 is illustrated in FIGS. 15–19 which includes back member 320 and tongue 360. The back member 320 has an overhanging finger 330 with a centrally disposed finger digit portion 340 extends downwardly over the back member 320. Tongue 360 forms a pivoting member having at the top portion thereof an axle 362 between rounded shoulders 364 and 366. Finger 330 and finger digit 340 form at the crook a pivot means which comprises a grooved seat 342 which pivotally receives the axle 362 of the tongue or pivoting member 360. Grooved seat 342 is sized and shaped to securely retain the axle 362, when the axle 362 is snapped into the grooved seat 342. The tongue 360 can be pivoted toward or away from the back member 320. Grooved seat 342 and axle 362 have cooperative locking means for holding tongue 360 in relative positions in relation to the back member wherein in this example comprises two predetermined positions namely, a closed position where the tongue 360 is pivoted such that it is held resiliently biased against the back member (FIG. 18), and an open position where tongue 360 is pivoted away from the back member and held in a spaced relationship to the back member (FIG. 19).

Locking means comprises an elongated rib 364 longitudinally disposed along the extent of the axle 362 and two channels 344 and 346 of similar cross-section to that of the rib, the channels being disposed longitudinally along the inner surface of the grooved seat 342. Rib 364 and first and second grooves 344 and 346 are positioned along the axle and arranged such that rib 364 seats in first channel 344 when the tongue 360 is pivoted onto contact with the back member 320 front surface 324. In this position, the locking means, via rib 364 and first groove 346, resiliently bias the tongue and back member together. In the closed position, the tongue and back member can tensionally retain papers, bulletins, envelopes or the like therebetween. The locking means prevents rotation of the tongue 360 when the tongue is in a closed position unless the tongue is urged out of this position by finger pressure. Upon such urging, the tongue 360 can be pivoted away from the back member until the elongated rib 364 seats in the second groove 346 where the tongue will be held in an open position.

As with the above-described embodiments, a pin (not shown), serving as the fastening means, may be integrally formed in the top portion of the clip. Alternatively, the pin may be inserted into the clip head portion by means of the arrangement described above in relation to FIG. 5. Other fastening arrangements as described herein for example, may also be employed to affix the pin to a desired location.

The above-described detailed description of a preferred embodiment describes the best mode contemplated by the inventor for carrying out the present invention at the time this application is filed and is offered by way of example and not by way of limitation. Accordingly, various modification may be made to the above-described preferred embodiment without departing from the scope of the invention. Accordingly, it should be understood that although the invention has been described and shown for a particular embodiment, nevertheless various changes and modifications obvious to a person of ordinary skill in the art to which the invention pertains are deemed to lie within the spirit and scope of the invention as set forth in the following claims.

What is claimed is:

1. A pin clip, comprising:

a tongue member having an opening therethrough;

a back member having a finger, a front member located adjacent the back member with the finger inserted through the opening of said tongue member and resiliently holding the tongue member against the back member, and cooperative pivoting and locking means on the tongue and back members to hold the members in relative pivotal position.

2. The pin clip defined in claim 1 wherein the cooperative pivoting and locking means comprises a channel and a groove arrangement disposed between the back and tongue members such that when mated pivotally hold the tongue and back members in relative fixed relationship.

3. The pin clip defined in claim 1 further comprising a pin for affixing the pin clip to a surface.

4. The pin clip defined in claim 3 wherein the pin has a head and the back member has a small hole therethrough for receiving the pin.

5. The pin clip defined in claim 4 wherein the back member further has a countersunk portion over the small hole, the countersunk portion being slightly smaller than the diameter of the pin head such that the pin head will fit snugly within the countersunk hole.

6. A pin clip, comprising:

a back member with an overhanging finger;

a tongue member having a top portion and a bottom portion and a hole therethrough, the tongue member adjacently located over the back member being resiliently held under the overhanging finger which extends through the hole and onto the tongue member, and a pivoting arrangement disposed between the back and tongue members such that pressure on the top portion of the tongue pivots the bottom portion of the tongue away from the back member.

7. The pin clip defined in claim 6 wherein the pivoting means comprises cooperative ridges and grooves disposed on the tongue and back members, the ridges serving as pivot points in the grooves.

8. The pin clip defined in claim 7 wherein the cooperative ridges and grooves are arranged on the tongue and back members in parallel but spaced relationship.

9. The pin clip defined in claim 6 wherein the finger is plate-like in shape.

10. The pin clip defined in claim 9 wherein the tongue member has a recessed area for the finger to seat.

11. The pin clip defined in claim 10 wherein the recessed area is sized and shaped similar to the plate shaped finger.

12. The pin clip defined in claim 6 wherein the pivot means further provides a locking mechanism to hold the tongue member and back member in fixed relationship.

13. A pin clip for holding articles which may be retained or removed from the pin clip by ones fingers, comprising:

a back member with top and bottom edges and an overhanging finger with a downwardly bent finger digit;

a tongue member with top and bottom edges and having a hole therethrough, the finger digit being inserted through the hole resiliently engaging the tongue member such that the tongue member seats adjacent the back member with the top and bottom edges essentially coextensive, and ridge and channel means disposed on the tongue and back members to hold the tongue and back members in relative position while providing a pivot point such that finger pressure at the top edge of the tongue pivots the bottom edge of the tongue away from the back member bottom edge.

14. The pin clip defined in claim 13 wherein the tongue has a recessed area sized and shaped similarly to the finger digit.

15. The pin clip defined in claim 14 wherein the ridge and channel means comprises a pair of ridges and a pair of channels arranged on the tongue and back members in parallel but spaced relationship outside the finger.

16. The pin clip defined in claim 15 wherein the tongue and back member are essentially planar.

17. The pin clip defined in claim 13 further comprising wall fastening means for securing the pin clip to a surface.

18. The pin clip defined in claim 17 wherein the fastening means comprises a pin extending out from the back member.

19. The pin clip defined in claim 17 wherein the fastening means comprises a pin with a head and the back member has a countersunk portion with a hole therethrough such that the pin extends through the hole with the pin head seating in the countersunk portion.

* * * * *